US005570575A

United States Patent [19]

Sato et al.

[11] Patent Number: 5,570,575

[45] Date of Patent: Nov. 5, 1996

[54] FUEL DELIVERY CONTROL APPARATUS FOR USE WITH INTERNAL COMBUSTION ENGINE

[75] Inventors: Ritsuo Sato, Atsugi; Kimiyoshi Nishizawa, Yokohama; Fuminori Yamanashi, Tokyo; Katsuhiro Shibata, Machida; Hideharu Ehara, Yokohama; Kaoru Ikeda, Omiya; Keiji Yakushiji, Yokohama; Ken Ouchi, Yokohama; Kiyotaka Baba, Yokohama, all of Japan

[73] Assignee: Nissan Motor Co., Ltd., Yokohama, Japan

[21] Appl. No.: 318,406

[22] Filed: Oct. 5, 1994

[30] Foreign Application Priority Data

Oct. 6, 1993 [JP] Japan ..... 5-249625
Dec. 29, 1993 [JP] Japan ..... 5-351702

[51] Int. Cl.[6] ..... F01N 3/28

[52] U.S. Cl. ..... 60/277; 60/285

[58] Field of Search ..... 60/277, 285

[56] References Cited

U.S. PATENT DOCUMENTS 4,656,829 4/1987 Creps ..... 60/277
4,729,220 3/1988 Terasaka ..... 60/277

*Primary Examiner*—Douglas Hart
*Attorney, Agent, or Firm*—Lowe, Price, LeBlanc & Becker

[57] ABSTRACT

A fuel delivery control apparatus for use with an internal combustion engine including an exhaust system having a catalytic converter containing catalysts operable at a temperature for purifying exhaust gases discharged through the exhaust system. A fuelcut control is performed to interrupt fuel delivery to the engine during engine deceleration. The fuelcut control is inhibited when the catalyst temperature exceeds a predetermined value.

3 Claims, 11 Drawing Sheets

FUEL DELIVERY CONTROL APPARATUS FOR USE WITH INTERNAL COMBUSTION ENGINE

FIELD OF THE INVENTION

This invention relates to a fuel delivery control apparatus for controlling the amount of fuel metered to an internal combustion engine of the type having an exhaust gas purifier provided in its exhaust system to minimize the emission of undesirable pollutants.

BACKGROUND OF THE RELATED ART

It is the current practice in the field of internal combustion engines to provide a good fuel economy by interrupting the fuel delivery to the engine in response to an operator's demand for deceleration. During the fuelcut control, however, the whole amount of air introduced into the engine is discharged into the exhaust system to increase the amount of oxygen supplied to the catalytic converter. As a result, oxidation is promoted rapidly to increase the catalyst temperature so as to degrade the catalysts.

For example, Japanese Patent Kokai No. 2-91438 discloses an air/fuel ratio leaning control made during deceleration to provide good fuel economy without excessive catalyst temperature increase. If a fuelcut control is made to produce a leaned air/fuel ratio during deceleration at high engine-speed and high engine-load conditions increasing the catalyst temperature, however, an excessive amount of hot air will enter the catalytic converter where the oxygen included in the hot air is jointed to the rhodium (Rh) contained in the catalysts. This results in a temporary reduction of the pollutant purifying capacity of the catalytic converter.

SUMMARY OF THE INVENTION

It is a main object of the invention to provide an improved fuel delivery control which is free from a temporarily catalyst degradation which may occur due to an excessive amount of air introduced into the catalytic converter operating at a high temperature.

There is provided, in accordance with the invention, a fuel delivery control apparatus for use with an internal combustion engine including an exhaust system having a catalytic converter containing catalysts operable at a temperature for purifying exhaust gases discharged through the exhaust system. The fuel delivery control apparatus comprises means for performing fuelcut control to interrupt fuel delivery to the engine during engine deceleration, means for estimating the catalyst temperature, means for inhibiting the fuelcut control when the estimated catalyst temperature exceeds a predetermined value and means for maintaining the fuelcut control inhibited as long as the engine deceleration continues.

In another aspect of the invention, the fuel delivery control apparatus comprises means for performing fuelcut control to interrupt fuel delivery to the engine during engine deceleration, means for detecting the catalyst temperature when the engine deceleration is started, and means for delaying performance of the fuelcut control when the detected catalyst temperature is in a first high-temperature region.

In still another aspect of the invention, the fuel delivery control apparatus comprises means for performing fuelcut control to interrupt fuel delivery to the engine during engine deceleration, means for estimating the catalyst temperature when the engine deceleration is started, and means for delaying performance of the fuelcut control when the estimated catalyst temperature is in a first high-temperature region.

BRIEF DESCRIPTION OF THE DRAWINGS

The invention will be described in greater detail by reference to the following description taken in connection with the accompanying drawings, in which.

DETAILED DESCRIPTION OF THE PREFERRED EMBODIMENTS

Figure 1:
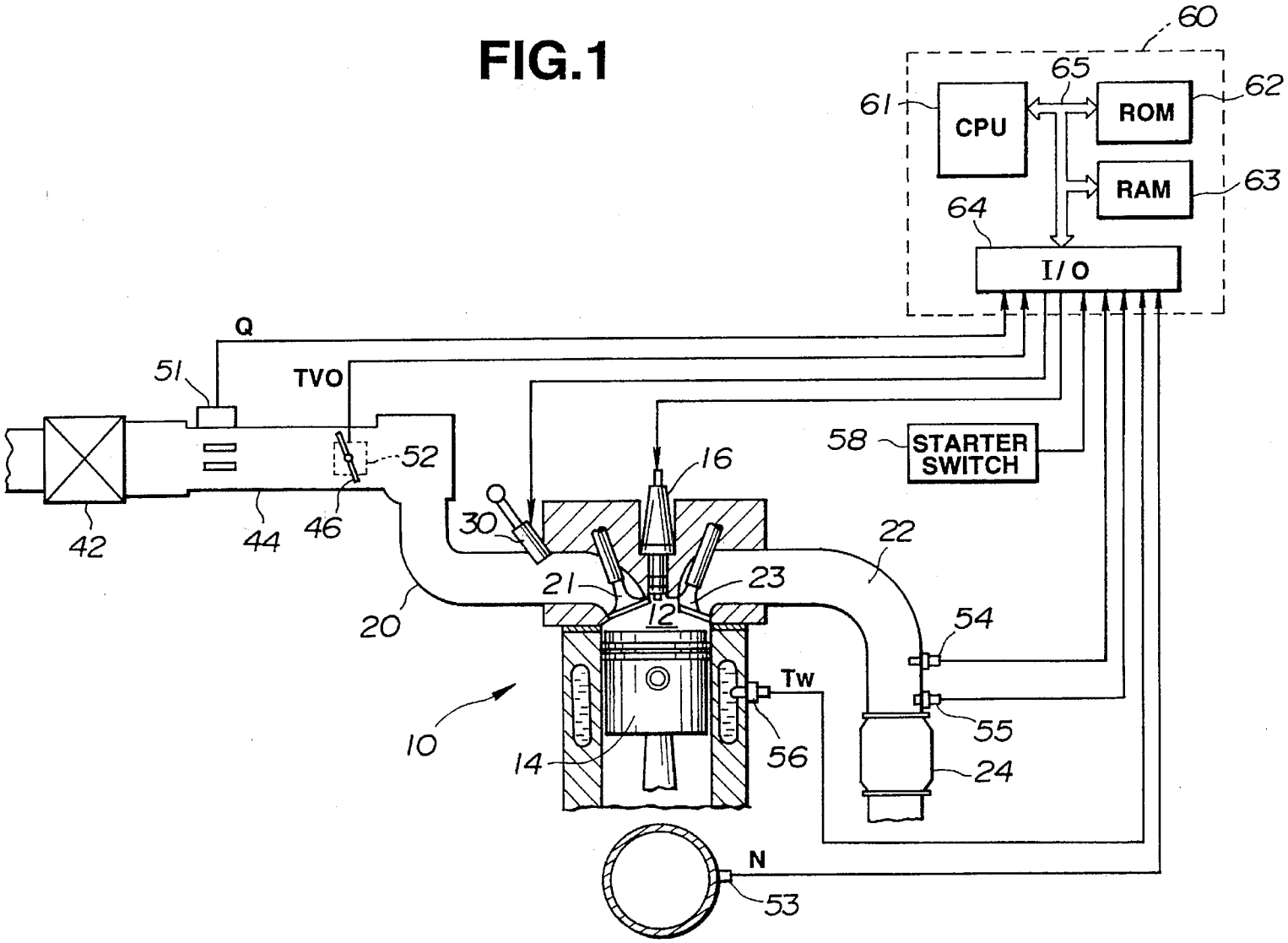
FIG. 1 is a schematic diagram showing one embodiment of a fuel delivery control apparatus made in accordance with the invention.

With reference to the drawings and in particular to FIG. 1, there is shown a schematic diagram of a fuel delivery control apparatus embodying the invention. An internal combustion engine, generally designated by the numeral 10, for an automotive vehicle includes combustion chambers or cylinders, one of which is shown at 12. A piston 14 is mounted for reciprocal motion within the cylinder 12. A crankshaft (not shown) is supported for rotation within the engine 10 in response to reciprocation of the piston 14 within the cylinder 12. An intake manifold 20 is connected with the cylinder 12 through an intake port with which an intake valve 21 is in cooperation for regulating the entry of combustion ingredients into the cylinder 12 from the intake manifold 20. A spark plug 16 is mounted in the top of the cylinder 12 for igniting the combustion ingredients within the cylinder 12 when the spark plug 16 is energized by the presence of high voltage electric energy. An exhaust manifold 22 is connected with the cylinder 12 through an exhaust port with which an exhaust valve 23 is in cooperation for regulating the exit of combustion products, exhaust gases, from the cylinder 12 into the exhaust manifold 22. The intake and exhaust valves 21 and 23 are driven through a suitable linkage with the crankshaft.

A fuel injector 30 is mounted for injecting fuel into the intake manifold 20 toward the intake valve 21. The fuel injector 30 opens to inject fuel into the intake manifold 20 when it is energized by the presence of an electrical signal. The length of the electrical pulse, that is, the pulse-width, applied to the fuel injector 30 determines the length of time the fuel injector 30 opens and, thus, determines the amount of fuel injected into the intake manifold 20. Air to the engine 10 is supplied through an air cleaner 42 into an induction passage 44. The amount of air permitted to enter the combustion chamber 12 through the intake manifold 20 is controlled by a butterfly throttle valve 46 located within the induction passage 44. The throttle valve 46 is connected by a mechanical linkage to an accelerator pedal (not shown). The degree to which the accelerator pedal is depressed controls the degree of rotation of the throttle valve 46. The accelerator pedal is manually controlled by the operator of the engine control system. In the operation of the engine 10, the exhaust gases are discharged into the exhaust manifold 22 and thence to the atmosphere through a conventional exhaust system. The exhaust system includes a catalytic converter 24 for minimizing the emission of the exhaust system into the ambient. For example, the catalytic converter 24 may be of the type using ternary or oxidation catalysts comprised of noble metals such as platinum and/or palladium or base metals promoted with noble metals disposed on both monolytic and pellet substrates.

The amount of fuel metered to the engine, this being determined by the width of the electrical pulses applied to the fuel injector 30 is repetitively determined from calculations performed by a digital computer, these calculations being based upon various conditions of the engine that are sensed during its operation. These sensed conditions include engine intake air flow Q, throttle valve position TVO, engine speed N, exhaust oxygen content, exhaust gas temperature T, engine coolant temperature Tw. Thus, an intake air flow meter 51, a throttle valve position sensor 52, a crankshaft position sensor 53, an oxygen sensor 54, an exhaust gas temperature sensor 55 and an engine coolant temperature sensor 56 are connected to a control unit 60. The control unit 60 is also connected to a starter switch 58 assembled in the key switch to produce a start signal. The intake air flow meter 51 is located in the intake passage 44 upstream of the throttle valve 46. The air flow meter 51 is responsive to the air flow through the induction passage 44 and it produces an intake airflow signal proportional thereto. The throttle valve position sensor 51 is associated with the throttle valve 46 and it produce a voltage signal proportional to the degree of opening of the throttle valve 46. The crankshaft position sensor 53 is provided for producing a series of crankshaft position electrical pulses, each corresponding to two degrees of rotation of the engine crankshaft, of a repetitive rate directly proportional to engine speed. The oxygen sensor 54 is an air/fuel ratio sensor provided to probe the exhaust gases discharged from the cylinder 12 and it is effective to produce a signal indicative of the air/fuel ratio at which the engine is operating. The exhaust gas temperature sensor 55 is mounted in the exhaust manifold 22 upstream of the catalytic converter 24 and it comprises a thermistor connected to an electrical circuit capable of producing an exhaust gas temperature signal in the form of a DC voltage having a variable level proportional to exhaust gas temperature. The engine coolant temperature sensor 56 is mounted in the engine cooling system and it comprises a thermistor connected to an electrical circuit capable of producing a coolant temperature signal in the form of a DC voltage having a variable level proportional to engine coolant temperature.

The control unit 60 calculates a basic value Tp for fuel-injection pulse-width as $Tp=k\cdot Q/N$ where k is a constant, Q is the intake air flow and N is the engine speed. The control unit 60 calculates various correction factors including an exhaust gas oxygen content related correction factor $\alpha$ used for a closed loop air/fuel ratio control, a car battery voltage related correction factor Ts and a correction factor COEF given as $COEF=1+KTW+KMR+KAS+KAI+KACC$ where KTW is a correction factor decreasing as the engine coolant temperature increases, KMR is a correction factor for providing fuel enrichment control under high engine load conditions, KAS is a correction factor for providing fuel enrichment control when the engine is cranking, KAI is a correction factor for providing fuel enrichment control when the engine is idling, and KACC is a correction factor for providing fuel leaning control during acceleration. A target value Ti for fuel-injection pulse-width is calculated as $Ti=Tp\times\alpha\times COEF+Ts$. The calculated target fuel-injection pulse-width value Ti is converted into a fuel injection pulse signal for application to a power transistor which connects the fuel injector 30 to the car battery for a time period calculated by the control unit 60.

The control unit 60 produces a command (fuelcut control signal) to interrupt the fuel delivery to the engine during deceleration. For example, the control unit 60 detects the operator's demand for deceleration by the use of throttle valve position singularly or with engine rotational speed. The control unit 60 inhibits the fuelcut control when the catalytic converter 24 operates at a temperature higher than a predetermined value.

The control unit 60 may comprise a digital computer which includes a central processing unit (CPU) 61, a read only memory (ROM) 62, a random access memory (RAM) 63, and an input/output control unit (I/O) 64. The central processing unit 61 communicates with the rest of the computer via data bus 65. The input/output control unit 64 includes an analog-to-digital converter which receives analog signals from the flow meter and other sensors and converts them into digital form for application to the central processing unit 61 which selects the input channel to be converted. The read only memory 62 contains programs for operating the central processing unit 61 and further contains appropriate data in look-up tables used in calculating appropriate values for fuel delivery requirement. The central processing unit 61 is programmed in a known manner to interpolate between the data at different entry points.

Figure 2:
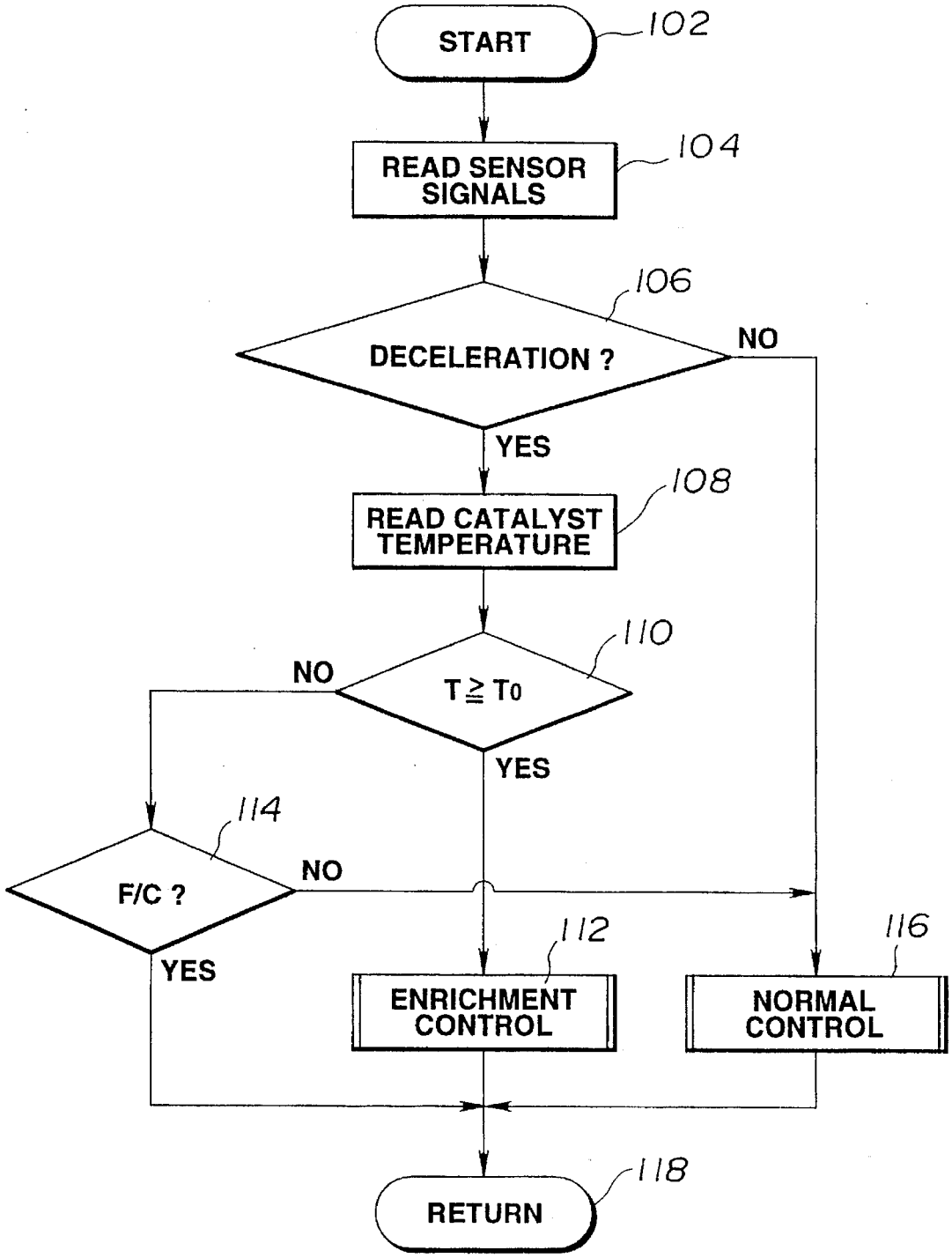
FIG. 2 is a flow diagram illustrating the programming of the digital computer as it is used for fuel delivery control.

FIG. 2 is a flow diagram illustrating the programming of the digital computer as it is used for fuel delivery control. The computer program is entered at the point 102 in the program. At the point 104 in the program, the sensor signals fed thereto from the sensors 51 to 56 are, one by one, read into the computer memory. At the point 106 in the program, a determination is made as to whether or not the engine is decelerating. This determination is made based on the throttle valve position signal fed from the throttle valve position sensor 52. If the answer to this question is "YES", then the program proceeds to the point 108. Otherwise, the program proceeds to the point 116 where a command is produced for normal fuel delivery control. At the point 108 in the program, the exhaust gas temperature T is read into the computer memory. At the point 110 in the program, a determination is made as to whether or not the exhaust gas temperature T is equal to or greater than a predetermined value $T_0$. If the answer to this question is "YES", then it is estimated that the catalytic converter temperature is greater than the permitted range and the program proceeds to the point 112 where a command is produced for fuel enrichment control. Following this, the program proceeds to the point 118. If the exhaust gas temperature T is less than the predetermined value $T_0$, then the program proceeds to another determination step at the point 114. This determination is as to whether or not the engine operating conditions are in a region specified for fuelcut control (F/C). If the answer to this question is "YES", then the program proceeds to the point 118 where the computer program is returned to the point 104. Otherwise, the program proceeds to the point 116 where a command is produced for normal fuel delivery control. Following this, the program proceeds to the point 118.

Figure 3:
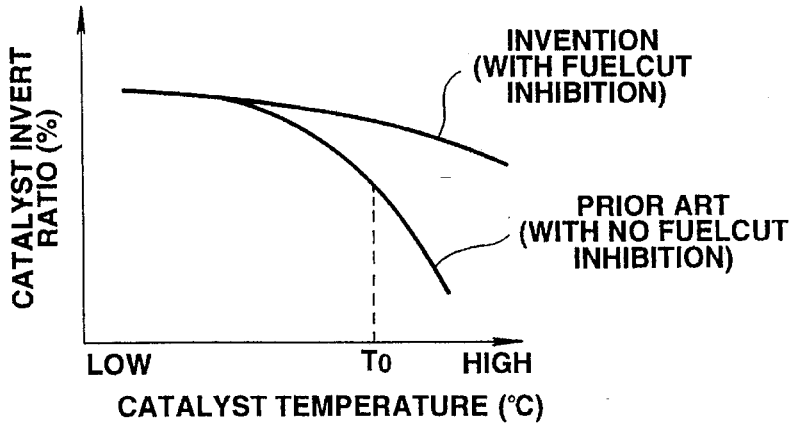
FIG. 3 is a graph of catalysis invert ratio versus catalytic converter temperature.

In this embodiment the fuelcut control (F/C) is inhibited to maintain a rich air/fuel ratio when a high catalytic converter temperature is estimated during deceleration. This is effective to avoid a temporarily catalyst degradation which may occur due to an excessive amount of air introduced into the catalytic converter operating at a high temperature. FIG. 3 is a graph showing comparative performances of the fuel delivery control apparatus. As can be seen from FIG. 3, the invention can ensure good catalysis invert ratio over the entire range of catalytic converter temperature as compared to the prior art.

Figure 5:
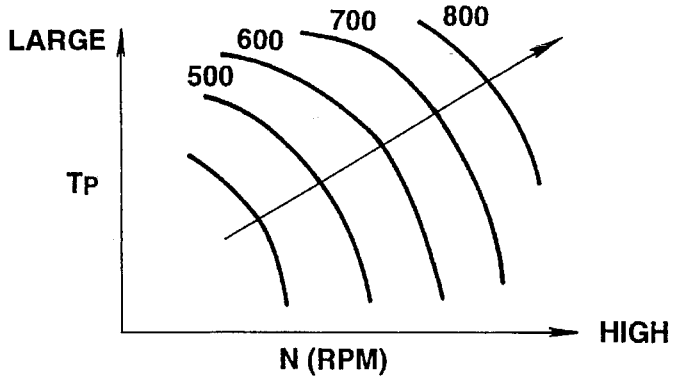
FIG. 5 is a graph of fuel-injection pulse-width basic value versus engine speed.
Figure 4:
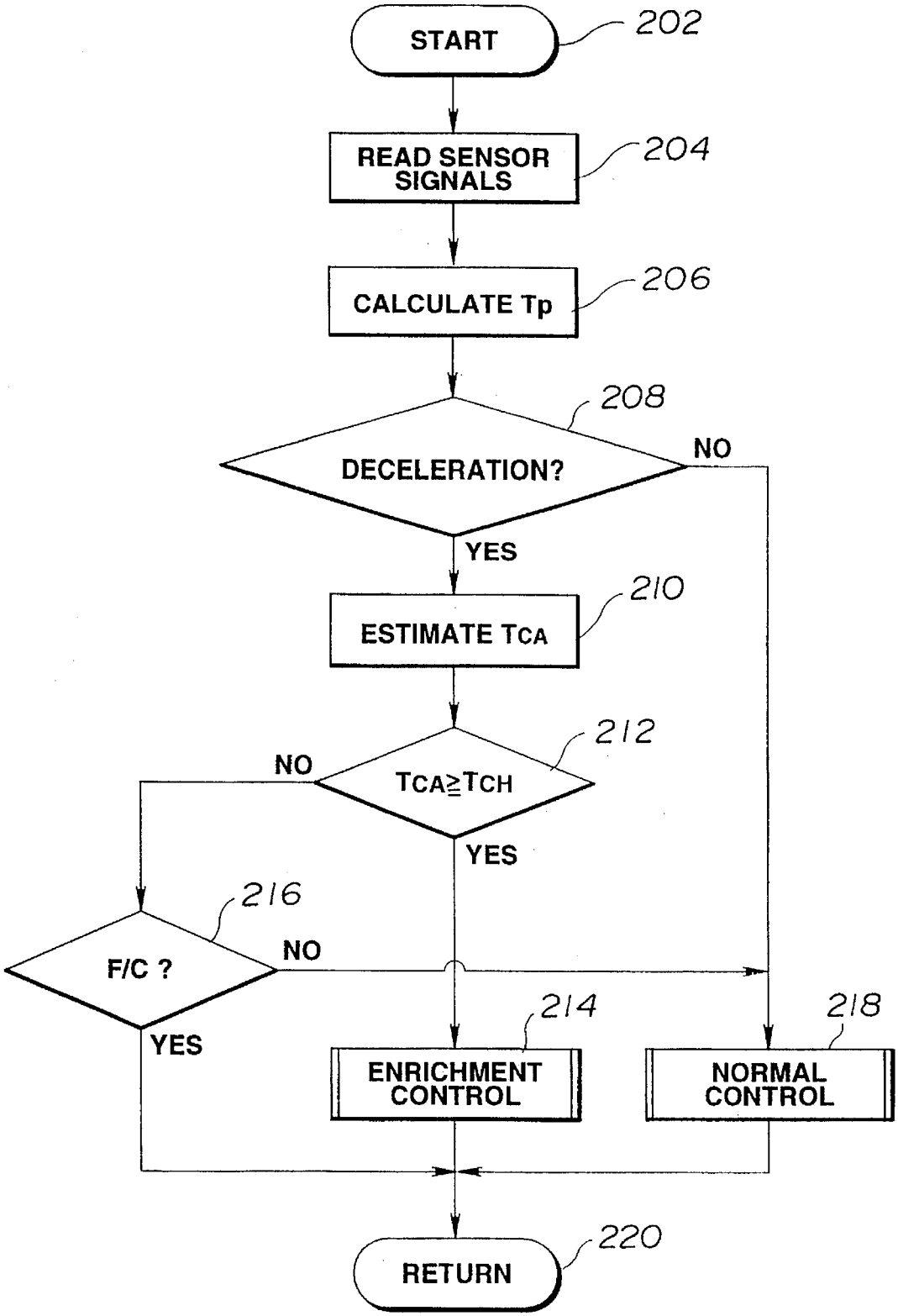
FIG. 4 is a flow diagram illustrating a modified form of the programming of the digital computer as it is used for fuel delivery control.

FIG. 4 is a flow diagram illustrating a modified form of the programming of the digital computer as it is used for fuel delivery control. The computer program is entered at the point 202 in the program. At the point 204 in the program, the sensor signals fed thereto from the sensors 51 to 56 are, one by one, read into the computer memory. At the point 206 in the program, a basic value Tp for fuel-injection pulse-width is calculated as a function of engine speed N and intake air flow Q. At the point 208 in the program, a determination is made as to whether or not the engine is decelerating. This determination is made based on the throttle valve position signal fed from the throttle valve position sensor 52. If the answer to this question is "YES", then the program proceeds to the point 210. Otherwise, the program proceeds to the point 218 where a command is produced for normal fuel delivery control. At the point 210 in the program, the catalytic converter temperature $T_{CA}$ is estimated from a relationship programmed into the computer. This relationship defines estimated catalytic converter temperature as a function of basic fuel-injection pulse-width value Tp and engine speed N, as shown in FIG. 5. At the point 212 in the program, a determination is made as to whether or not the exhaust gas temperature $T_{CA}$ is equal to or greater than a predetermined value $T_{CH}$. If the answer to this question is "YES", then it is estimated that the catalytic converter temperature is greater than the permitted range and the program proceeds to the point 214 where a command is produced for fuel enrichment control. Following this, the program proceeds to the point 220. If the exhaust gas temperature $T_{CA}$ is less than the predetermined value $T_{CH}$, then the program proceeds to another determination step at the point 216. This determination is as to whether or not the engine operating conditions are in a region specified for fuelcut control (F/C). If the answer to this question is "YES", then the program proceeds to the point 220 where the computer program is returned to the point 204. Otherwise, the program proceeds to the point 218 where a command is produced for normal fuel delivery control. Following this, the program proceeds to the point 220.

In this modification, the catalytic converter temperature is estimated as a function of basic fuel-injection pulse-width and engine speed. It is, therefore, possible to eliminate the need for exhaust gas temperature sensor 55.

Figure 7:
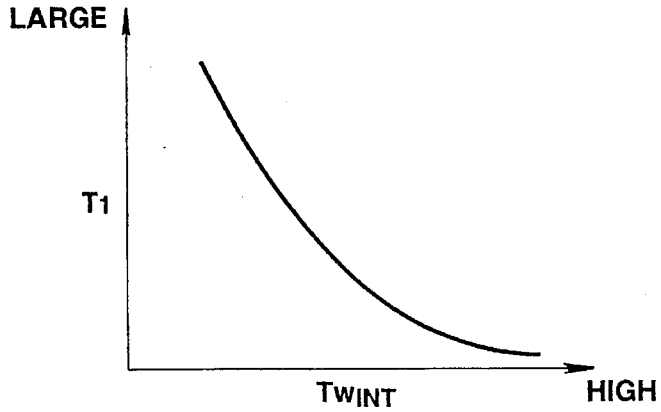
FIG. 7 is a graph of warming time versus engine coolant temperature.
Figure 6:
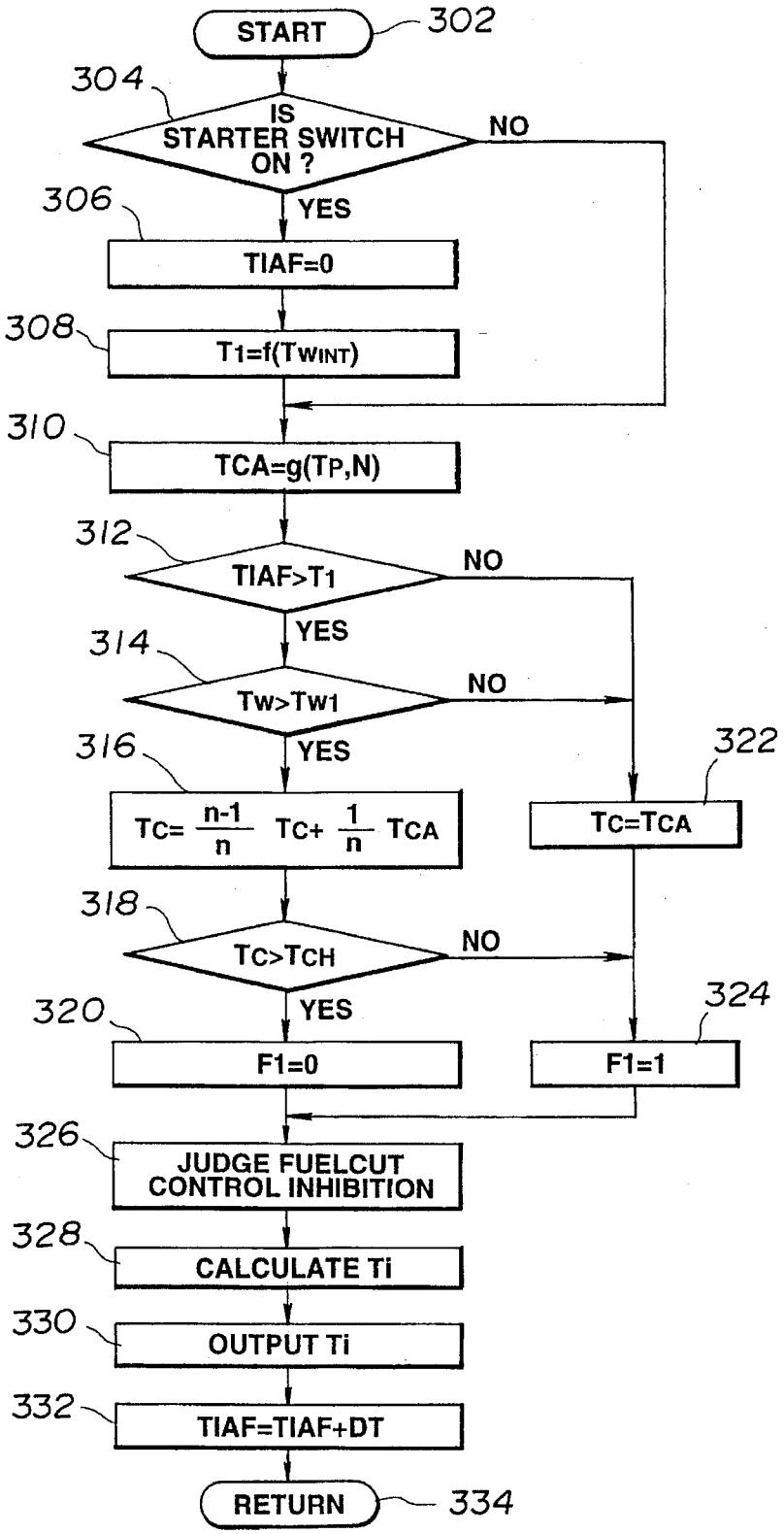
FIG. 6 is an overall flow diagram illustrating a modified form of the programming of the digital computer as it is used for fuel delivery control.

FIG. 6 is an overall flow diagram illustrating the programming of the digital computer as it is used for fuel delivery control. The computer program is entered at the point 302. At the point 304 in the program, a determination is made as to whether or not the starter switch 58 is turned on. If the answer to this question is "YES", then it means that the engine 10 is starting and the program proceeds to the point 306 where the count TIAF of a timer is reset. Otherwise, the program proceeds to the point 310. At the point 306 in the program, a warming time T1 required to warm the catalytic converter 24 is calculated from a relationship programmed into the computer. This relationship defines the time T1 as a function of the engine coolant temperature $TW_{INT}$ measured just after the engine 10 is started, as shown in FIG. 7. The time T1 decreases with increasing engine coolant temperature $TW_{INT}$. At the point 310 in the program, the temperature $T_{CA}$ of the catalytic converter 24 is estimated as a function of the basic fuel-injection pulse-width value Tp and the engine speed N, as described above in connection with FIG. 5. At the point 312 in the program, a determination is made as to whether or not the content of the timer TIAF, that is, the length of time the starter switch 58 remains on, is greater than the warming time value T1. If the answer to this question is "YES", then the program proceeds to the point 314. Otherwise, the program proceeds to the point 322. At the point 314 in the program, a determination is made as to whether or not the engine coolant temperature Tw is greater than the engine warming time value Tw1. If the answer to this question is "YES", then it means that the engine has been warmed and the program proceeds to the point 316. Otherwise, the program proceeds to the point 322 where the catalytic temperature $T_{CA}$ estimated at the point 310 is used to update the last catalytic converter temperature value $T_C$ stored in the computer memory. Following this, the program proceeds to the point 324.

At the point 316 in the program, the weighted average of the catalytic converter temperature value $T_{CA}$ calculated at the point 310 and the last catalytic converter temperature value $T_C$ stored in the computer memory is calculated to obtain a new catalytic converter temperature value $T_C$ as $T_C=(n-1)/n\times T_C+(1/n)\times T_{CA}$. The calculated new catalytic converter temperature value $T_C$ is used to update the last catalytic converter temperature value $T_C$. At the point 318 in the program, a determination is made as to whether or not the calculated new catalytic converter temperature value $T_C$ is greater than a predetermined value $T_{CH}$. If the answer to this question is "YES", then it means that the engine operating conditions are in a region where the catalytic converter temperature is higher than a permitted range and the program proceeds to the point 320 where a first flag F1 is cleared to zero. Following this, the program proceeds to the point 326. If $T_C \leqq T_{CH}$, then the program proceeds from the point 318 to the point 324 where the first flag F1 is set at 1. Following this, the program proceeds to the point 326 where the fuelcut control inhibition is judged.

At the point 328 in the program, the target value Ti for fuel-injection pulse-width is calculated as $ti=Tp\times\alpha\times COEF+Ts$. At the point 330 in the program, the central processing unit 61 transfers a control word specifying the calculated target value Ti for fuel-injection pulse-width to the fuel-injection circuit included in the input/output control unit 64. The fuel injection control circuit converts the received control word into a fuel injection pulse signal for application to a power transistor which connects the fuel injector 30 to the car battery for a time period calculated by the digital computer. At the point 332 in the program, a command is produced to increase the count TIAF of the by DT which is the time required for one cycle of execution of this program. Following this, the program proceeds to the point 334 where the computer program is returned to the point 304.

Figure 8:
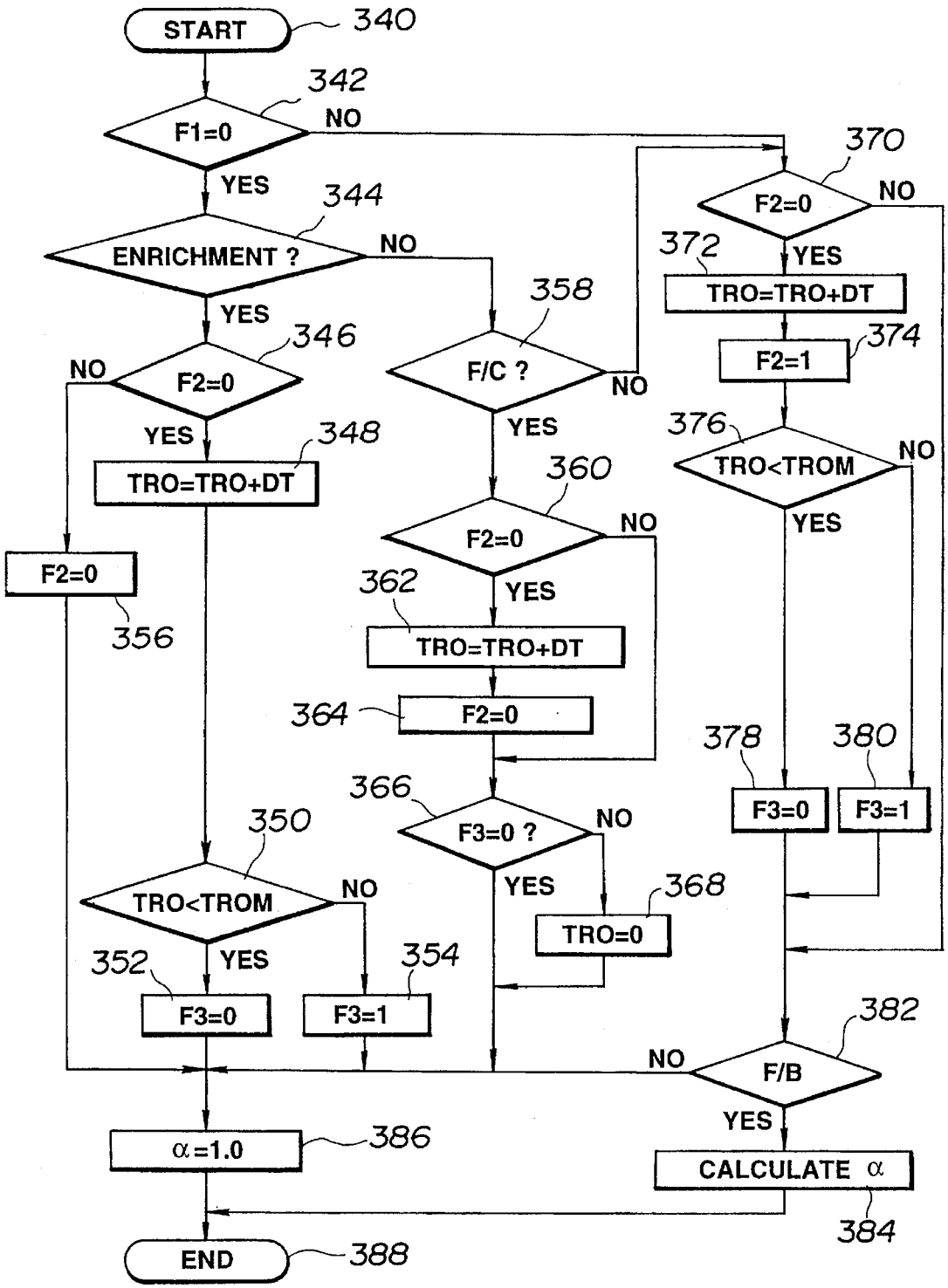
FIG. 8 is a detailed flow diagram illustrating the programming of the digital computer as it is used for fuelcut control inhibition judgement.

FIG. 8 is a flow diagram illustrating the above judgement of the fuel-cut control inhibition. At the point 340 in FIG. 8, which corresponds to the point 326 of FIG. 6, the computer program is entered. At the point 342, a determination is made as to whether or not the first flag F1 is cleared to zero (F1=0). If F1=0, then it means that the engine operating conditions are in a region specified for the catalytic converter 24 to operate at a high temperature and the program proceeds to the point 344. Otherwise, the program proceeds to the point 370. At the point 344 in the program, another determination is made as to whether or not the engine operating conditions are in a region specified for fuel enrichment control. If the answer to this question is "YES", then the program proceeds to the point 346. Otherwise, the program proceeds to the point 358.

At the point 346 in the program, a determination is made as to whether or not a second flag F2 is cleared to zero. The second flag F2 is cleared to indicate that the length of time of the fuel enrichment control should be counted (added). If the answer to this question is "YES", then the program proceeds to the point 348 where the last count value TRO is updated as TRO=TRO+DT. Following this, the program proceeds to a determination step at the point 350. This determination is as to whether or not the count TRO of the timer is less than a predetermined value TROM. If TRO<TROM, then it means that the air/fuel ratio has not been enriched to an extent sufficient to restore the catalytic converter 24 and the program proceeds to the point 252 where a third flag is cleared to indicate that the fuel-cut control should be inhibited. Upon completion of this flag clearance, the program proceeds to the point 386. If TRO≧TROM, then the program proceeds from the point 350 to the point 354 where the third flag F3 is set at 1 and to the point 386 where the air/fuel ratio feedback correction factor α is clamped at 1 (α=1). Following this, the program proceeds to the end point 388 which corresponds to the point 328 of FIG. 6. If the answer to this question inputted at the point 346 is "NO", then the program proceeds to the point 356 where the second flag F2 is cleared to 0 and to the point 386.

If the answer to this question inputted at the point 344 is "NO", then the program proceeds to another determination step at the point 358. This determination is as to whether or not the engine operating conditions are in a region specified for fuelcut control (F/C). If the answer to this question is "YES", then the program proceeds to the point 360. Otherwise, the program proceeds to the point 370. At the point 360 in the program, a determination is made as to whether or not the second flag F2 is cleared. If the answer to this question is "YES", then it mean that the engine operating conditions were in the range specified for fuel enrichment control in the last cycle of execution of this program and the program proceeds to the point 362 where the last count TRO is updated as TR=TRO+DT. At the point 364 in the program, the second flag F2 is set at 1. Upon completion of this second flag setting operation, the program proceeds to a determination step at the point 366. This determination is as to whether or not the third flag is cleared. If the answer to this question is "YES", then it means that the fuel-cut control should be inhibited and the program proceeds to the point 386. Otherwise, it means that the fuel enrichment control has been performed for a long time sufficient to restore the catalytic converter 25 and the program proceeds to the point 368 where the timer is reset (TRO=0) and to the point 386.

At the point 370 in the program, a determination is made as to whether or not the second flag F2 is cleared. If the answer to this question is "YES", then it means that the fuel enrichment control has been made in the last cycle of execution of this program and the program proceeds to the point 372. Otherwise, the program proceeds to the point 382. At the point 372 in the program, the last count TRO is updated as TRO=TRO+DT. At the point 374 in the program, the second flag F2 is set at 1. Upon completion of the second flag setting operation, the program proceeds to a determination step at the point 376. This determination is as to whether or not the count TRO of the timer is less than the predetermined value TROM. If the answer to this question is "YES", then it means that the length of time of the fuel enrichment control is insufficient to restore the catalytic converter 24 and the program proceeds to the point 378 where the third flag F3 is cleared to 0 and to the point 382. Otherwise, the program proceeds to the point 380 where the third flag is set at 1 and then to the point 382. At the point 382 in the program, a determination is made as to whether or not the engine operating conditions are in a region specified for air/fuel ratio feedback control (F/B). If the answer to this question is "YES", then the program proceeds to the point 384 where the air/fuel ratio feedback correction factor α is calculated based on the output of the oxygen sensor 54 in a manner to bring the air/fuel ratio closer to a stoichiometric value. Following this, the program proceeds to the end point 388. If the answer to the question inputted at the point 382 is "NO", then it means that no air/fuel ratio feedback control is required and the program proceeds to the point 386.

In this embodiment, the judgement as to whether or not the fuel-cut control inhibition is released is made based on the length of time during which the fuel enrichment control continues. It is, therefore, possible to minimize the fuel economy loss by releasing the fuel-cut control inhibition if the fuel enrichment control continues for a time sufficient to restore the catalytic converter 24 even when the engine operating conditions are in a range specified for the catalytic converter 24 to operate at a high temperature.

Figure 9:
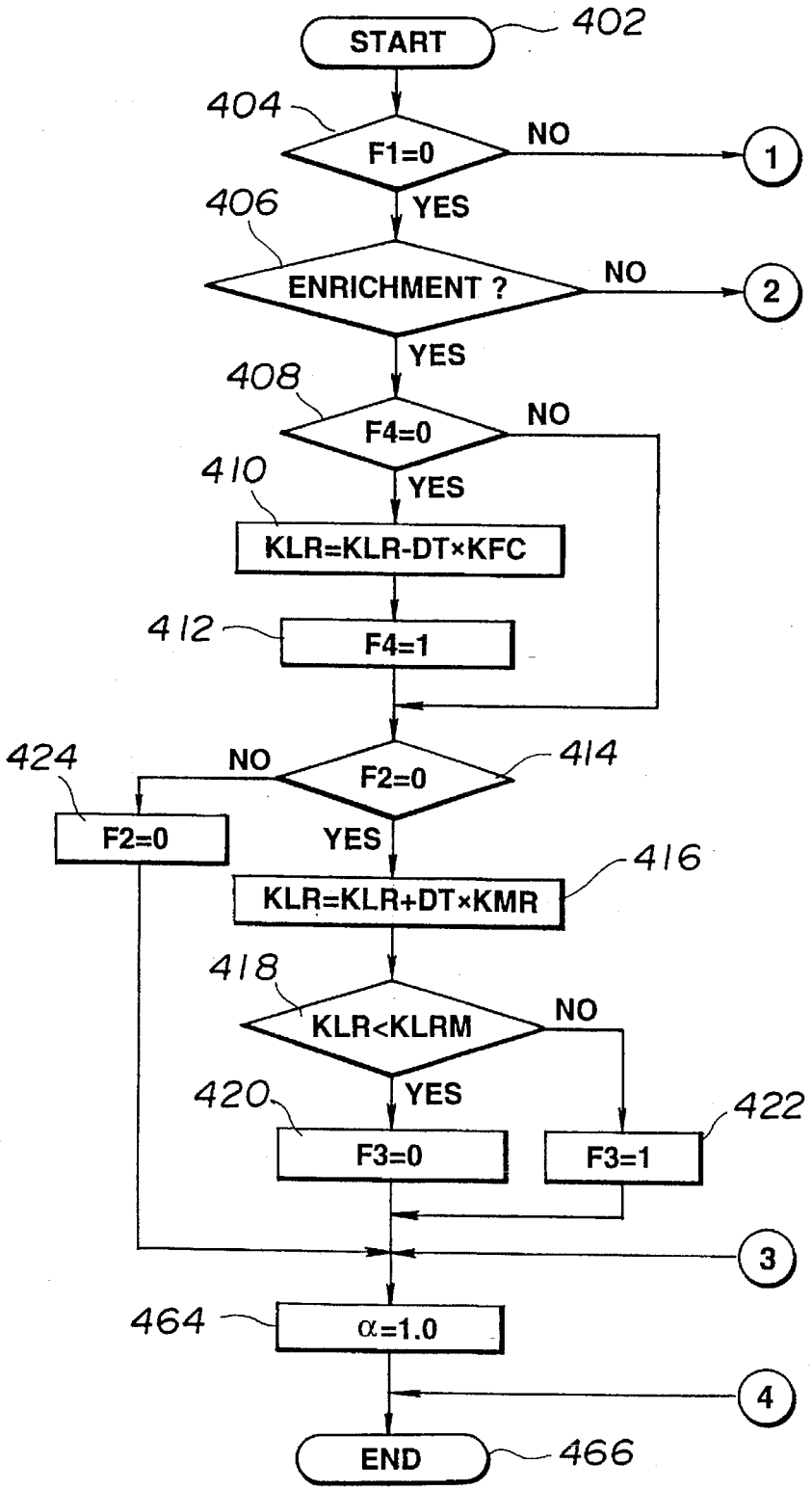
FIGS. 9 and 10 are detailed flow diagrams illustrating a modified form of the programming of the digital computer as it is used for fuelcut control inhibition judgement.
Figure 10:
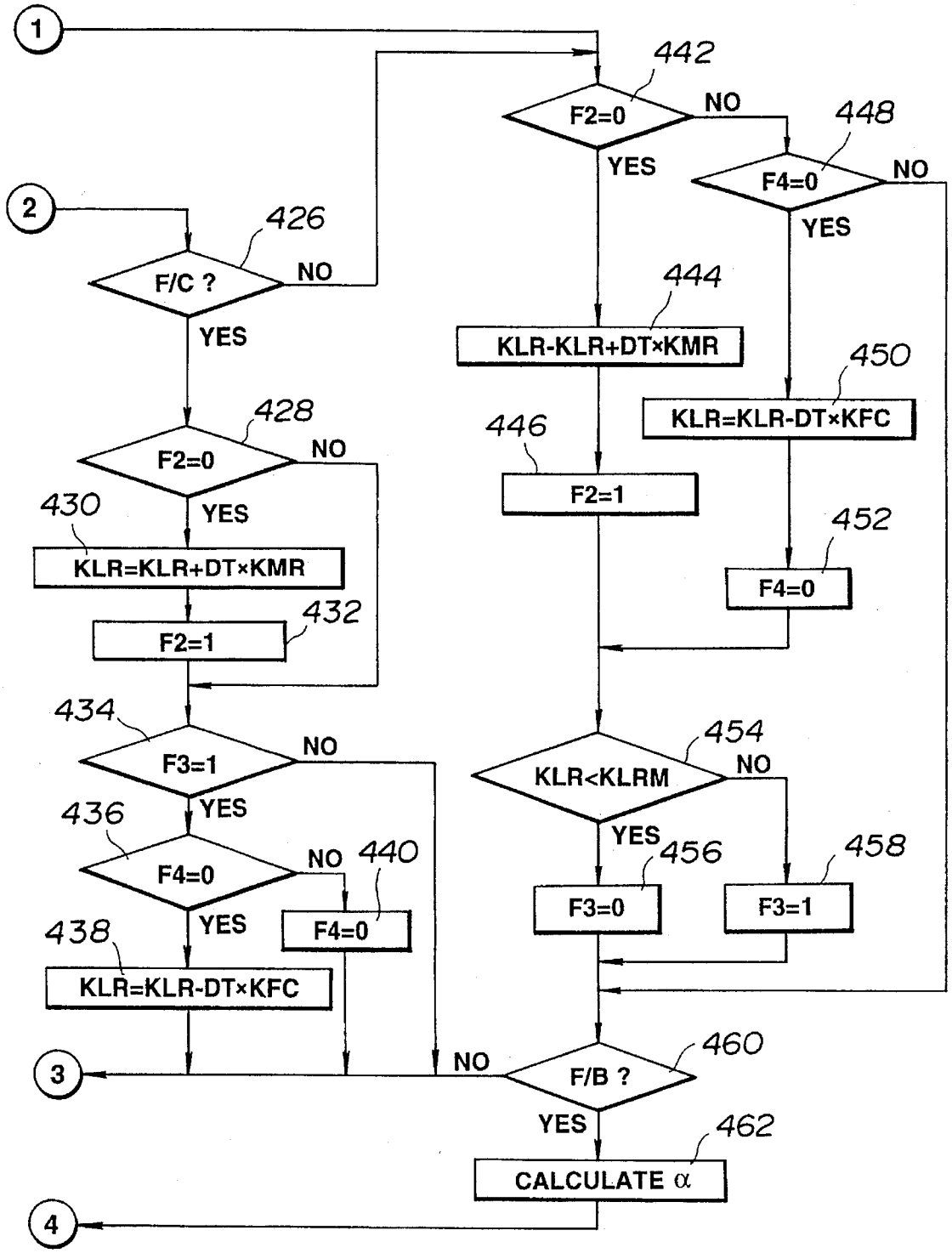

FIGS. 9 and 10 are flow diagrams illustrating the above judgement of the fuel-cut control inhibition. At the point 402 in FIG. 9, which corresponds to the point 326 of FIG. 6, the computer program is entered. At the point 404, a determination is made as to whether or not the first flag F1 is cleared to zero (F1=0). If F1=0, then it means that the engine operating conditions are in a region specified for the catalytic converter 24 to operate at a high temperature and the program proceeds to the point 406. Otherwise, the program proceeds to the point 442. At the point 406 in the program, another determination is made as to whether or not the engine operating conditions are in a region specified for fuel enrichment control. If the answer to this question is "YES", then the program proceeds to the point 408. Otherwise, the program proceeds to the point 426.

At the point 408 in the program, a determination is made as to whether or not a fourth flag F4 is cleared to zero. If the answer to this question is "YES", then it means that fuelcut control was made in the last cycle of execution of this program and the program proceeds to the point 430 where a new value KLR is calculated as KLR=KLR−DT×KFC where DT is the length of time of the fuelcut control during which the fuel delivery to the engine is interrupted and KFC is the rate at which the fuel metered to the engine is decreased. Thus, the product DT×KFC indicates the amount of fuel decreased by the fuelcut control during one cycle of execution of this program. At the point 412 in the program, the fourth flag is set at 1 to indicate that no fuelcut control is performed in this cycle of execution of the program. Upon completion of this fourth flag setting operation, at the point 414, a determination is made as to whether or not the second flag F2 is cleared. If the answer to this question is "YES", then the program proceeds to the point 416 where a new value KLR is calculated as KLR=KLR+DT×KMR where DT is the length of time of the fuel enrichment control during which the fuel delivery to the engine is increased and KMR is the rate at which the fuel metered to the engine is increased during one cycle of execution of this program. Thus, the product DT×KMR indicates the amount of fuel increased by the fuel enrichment control during one cycle of execution of this program. Following this, the program proceeds to a determination step at the point 418. This determination is as to whether or not the count KLR is less than a predetermined value KLRM. If KLR<KLRM, then it means that the air/fuel ratio has not been enriched to an extent sufficient to restore the catalytic converter 24 and the program proceeds to the point 252 where a third flag F3 is cleared to indicate that the fuel-cut control should be inhibited. Upon completion of this third flag clearance, the program proceeds to the point 464. If KLR≧KLRM, then the program proceeds from the point 418 to the point 422 where the third flag F3 is set at 1 and to the point 464 where the air/fuel ratio feedback correction factor α is clamped at 1 (α=1). Following this, the program proceeds to the end point 466 which corresponds to the point 328 of FIG. 6. If the answer to this question inputted at the point 414 is "NO", then the program proceeds to the point 424 where the second flag F2 is cleared to 0 and to the point 464.

At the point 426 in the program, a determination is made as to whether or not the engine operating conditions are in a range specified for fuelcut control. If the answer to this question is "YES", then the program proceeds to the point 428. Otherwise, the program proceeds to the point 442. At the point 428 in the program, a determination is made as to whether or not the second flag F2 is cleared. If the answer to this question is "YES", then it mean that the engine operating conditions were in the region specified for fuel enrichment control in the last cycle of execution of this program and the program proceeds to the point 430 where the last count value KLR is updated as KLR=KLR+DT×KMR. At the point 432 in the program, the second flag F2 is set at 1. Upon completion of this second flag setting operation, the program proceeds to a determination step at the point 434. This determination is as to whether or not the third flag F3 is set at 1. If the answer to this question is "YES", then it means that the fuelcut control inhibition has been released and the program proceeds to the point 436. Otherwise, the program proceeds to the point 464. At the point 436 in the program, a determination is made as to whether or not the fourth flag is cleared to zero. If the answer to this question is "YES", then it means that the fuelcut control was performed during the last cycle of execution of this program and the program proceeds to the point 438 where the last count value KLR is updated as KLR=KLR−DT×KFC and to the point 464. Otherwise, the program proceeds to the point 440 where the fourth flag F4 is cleared to zero and to the point 464.

At the point 442 in the program, a determination is made as to whether or not the second flag F2 is cleared. If the answer to this question is "YES", then it means that the fuel enrichment control was made in the last cycle of execution of this program and the program proceeds to the point 444 where the last count KLR is updated as KLR=KLR+DT×KMR. At the point 446 in the program, the second flag F2 is set at 1. Upon completion of this second flag setting operation, the program proceeds to a determination step at the point 454. This determination is as to whether or not the count KLR is less than the predetermined value KLRM. If the answer to this question is "YES", then it means that the increased fuel amount is insufficient to restore the catalytic converter 24 and the program proceeds to the point 456 where the third flag F3 is cleared to 0 and to the point 460. Otherwise, the program proceeds to the point 458 where the third flag is set at 1 and then to the point 460. At the point 460 in the program, a determination is made as to whether or not the engine operating conditions are in a region specified for air/fuel ratio feedback control. If the answer to this question is "YES", then the program proceeds to the point 462 where the air/fuel ratio feedback correction factor α is calculated based on the output of the oxygen sensor 54 in a manner to bring the air/fuel ratio closer to a stoichiometric value. Following this, the program proceeds to the end point 466. If the answer to the question inputted at the point 460 is "NO", then it means that no air/fuel ratio feedback control is required and the program proceeds to the point 464.

If the answer to the question inputted at the point 442 is "NO", then the program proceeds to another determination step at the point 448. This determination is as to whether or not the fourth flag F4 is cleared to zero. If the answer to this question is "YES", then it means that the fuelcut control was made in the last cycle of execution of this program and the program proceeds to the point 450 where the last count KLR is updated as KLR=KLR−DT×KFC and to the point 452 where the fourth flag f4 is set at 1. Upon completion of the fourth flag setting operation, the program proceeds to the point 454.

In this embodiment, the judgement as to whether or not the fuel-cut control inhibition is released is made based on an increased fuel amount estimated by subtracting the amount of fuel decreased during fuelcut control from the amount of fuel increased during fuel enrichment control. It is, therefore, possible to improve the accuracy of estimation of the degree to which the catalytic converter 24 is restored as compared to the embodiment of FIG. 8.

Figure 11:
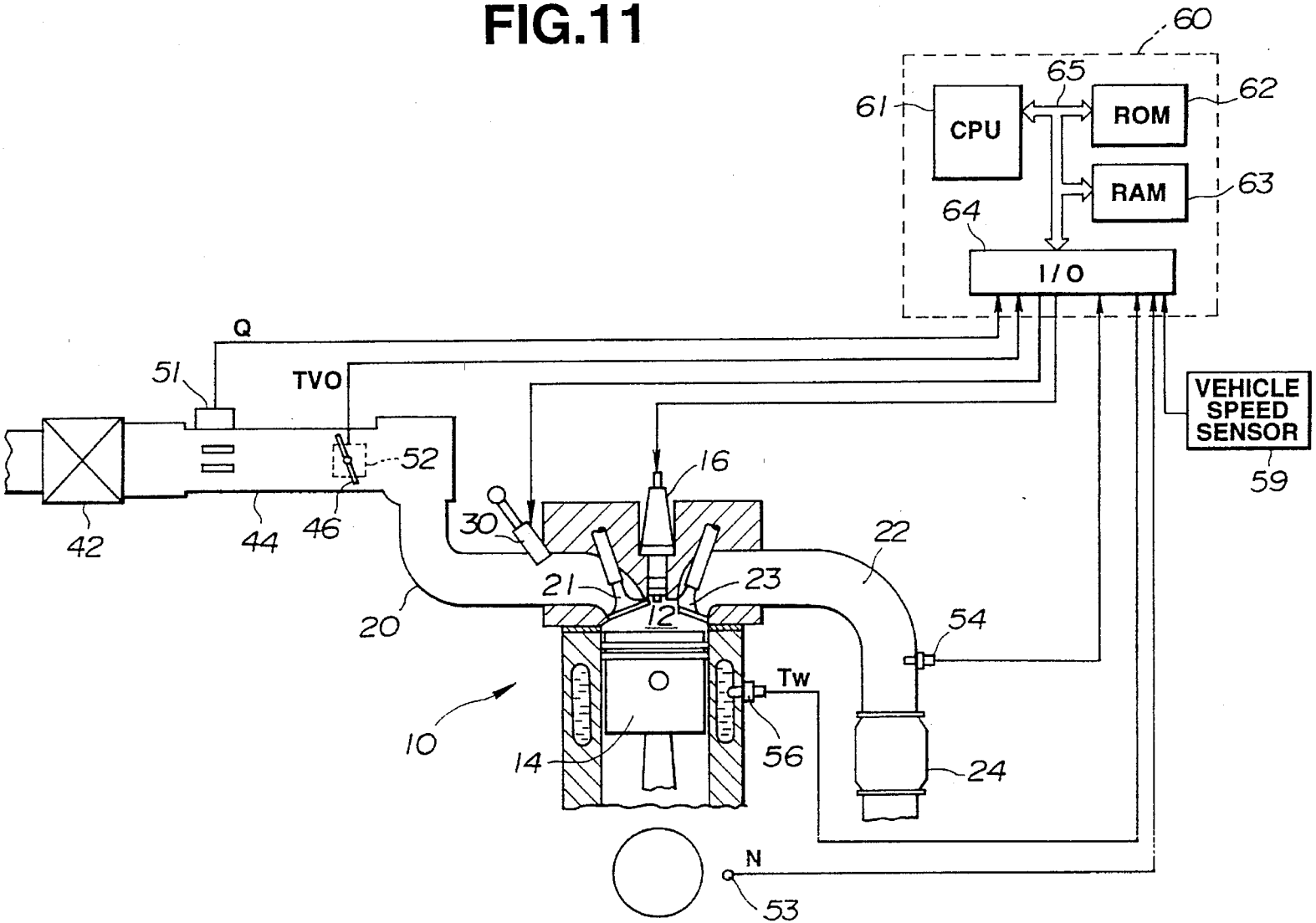
FIG. 11 is a schematic diagram showing a second embodiment of the fuel delivery control apparatus of the invention.
Figure 12:
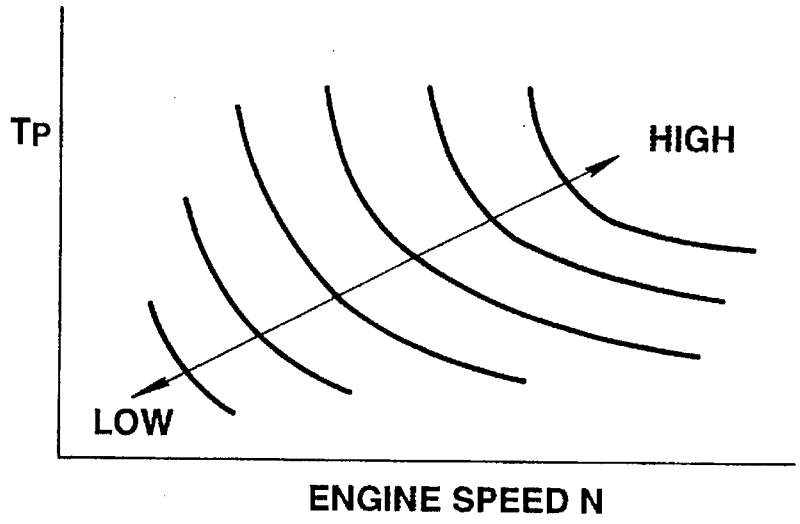
FIG. 12 is a graph of fuel-injection pulse-width basic value versus engine speed.
Figure 13:
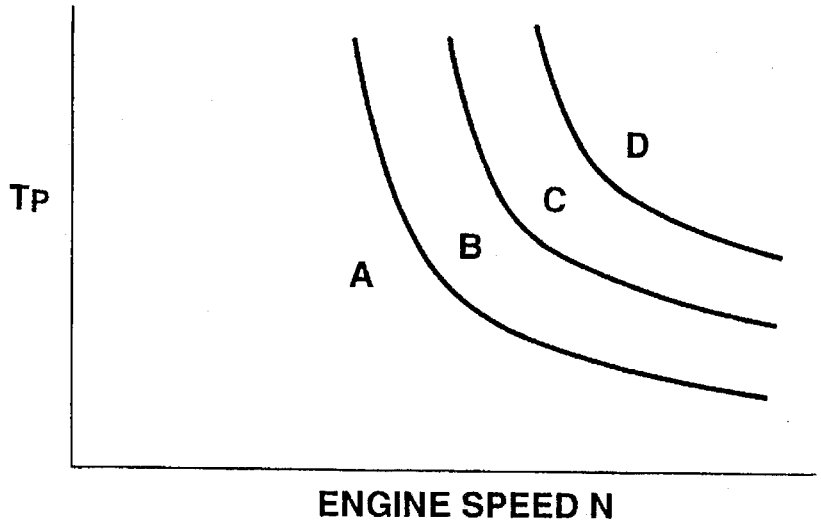
FIG. 13 is a graph of fuel-injection pulse-width basic value versus engine speed.

Referring to FIG. 11, there is shown a second embodiment of the fuel delivery control apparatus of the invention. This embodiment is substantially the same in the circuit arrangement as the first embodiment of FIG. 1 except that a vehicle speed sensor 59 is connected to the control unit 60 with the exhaust gas temperature sensor 55 removed. In this embodiment, the temperature of the catalytic converter 24 is not measured directly and estimated based on engine operating conditions in the term of engine load and engine speed. The engine load may be inferred from the basic value Tp calculated for fuel-injection pulse-width. In view of the fact that the exhaust gas temperature, which corresponds to the temperature at the entry of the catalytic converter 24, is low at low engine-speed and low engine-load conditions and high at high engine-speed and high engine-load conditions, as shown in FIG. 12, the exhaust gas temperatures may be divided into a plurality of regions A, B, C and D, as shown in FIG. 13. The region A relates to about 800° C. or lower exhaust gas temperatures, the region B relates to exhaust gas temperatures ranging from about 800° C. to about 850° C., the region C relates to exhaust gas temperatures ranging from about 850° C. to about 900° C., and the region D relates to about 900° C. or higher exhaust gas temperatures.

Figure 14:
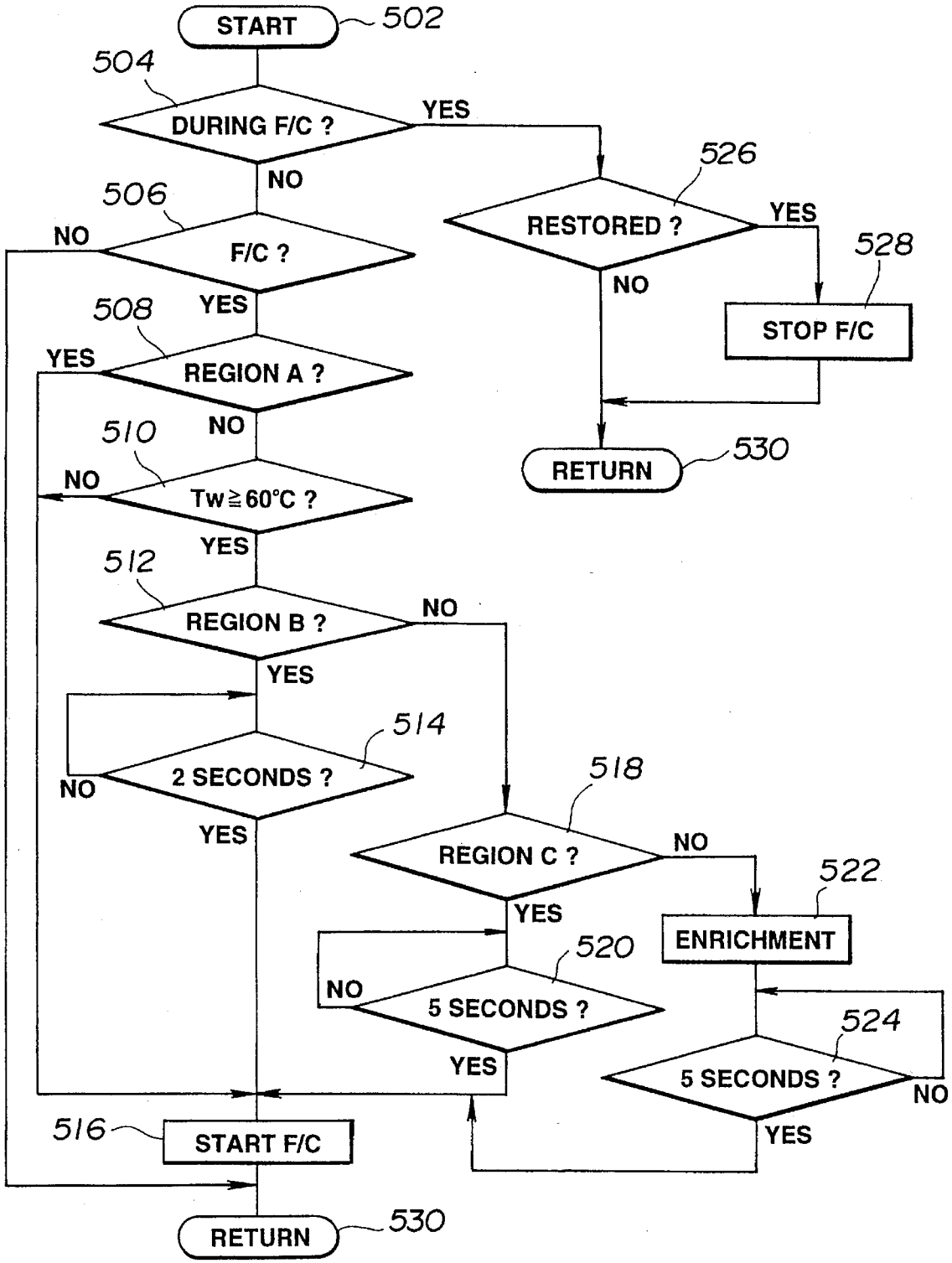
FIG. 14 is a flow diagram illustrating the programming of the digital computer as it is used for fuel delivery control.

FIG. 14 is a flow diagram illustrating the programming of the digital computer as it is used for fuel delivery control made in the second embodiment of the invention. The computer program is entered at the point 502. At the point 504 in the program, a determination is made as to whether or not a fuelcut (F/C) control is performed, that is, whether or not the fuel delivery to the engine is interrupted. If the answer to this question is "YES", then the program proceeds to the point 526. Otherwise, the program proceeds to another determination step at the point 506. This determination is as to whether or not the engine operating conditions are in a region specified for fuelcut (F/C) control. For example, the fuelcut control is performed upon the occurrence of three conditions; namely, closing of the throttle valve 46, engine coolant temperature Tw in excess of a predetermined value and engine speed N in excess of a predetermined value. At the point 508 in the program, a determination is made as to whether or not the engine operating conditions, in terms of engine speed N and fuel-injection pulse-width basic value Tp, indicate the region A of FIG. 13. If the answer to this question is "YES", then the program proceeds to the point 516 where the fuelcut control is started and to the point 530 where the computer program is returned to the point 504. Otherwise, the program proceeds to another determination step at the point 510. This determination is as to whether or not the engine coolant temperature is higher than 60° C. If the answer to this question is "YES", then the program proceeds to the point 512. Otherwise, it means that the engine is cold and the program proceeds to the point 516. At the point 512 in the program, a determination is as to whether or not the engine operating conditions, in terms of engine speed N and fuel-injection pulse-width basic value Tp, indicate the region B of FIG. 13. If the answer to this question is "YES", then the program proceeds to the point 514. Otherwise, the program proceeds to the point 518. At the point 514 in the program, a determination is made as to whether or not 2 seconds have been elapsed. If the answer to this question is "YES", then the program proceeds to the point 516 where the fuelcut (F/C) control is started. Otherwise, the program is returned to the point 514. This is effective to provide a delay of 2 seconds until the fuelcut control is started.

At the point 518 in the program, a determination is made as to whether or not the engine operating conditions, in terms of engine speed N and fuel-injection pulse-width basic value Tp, indicate the region C of FIG. 13. If the answer to this question is "YES", then the program proceeds to another determination step at the point 520. This determination is as to whether or not 5 seconds have been elapsed. If the answer to this question is "YES", then the program proceeds to the point 516 where the fuelcut control is started. Otherwise, the program is returned to the point 520. This is effective to provide a delay of 5 seconds until the fuelcut control is started. The fuelcut control is delayed a longer time for the region C than for the region B since the catalytic converter temperature is higher in the region C than in the region B. If the answer to the question inputted at the point 518 is "NO", then it means that the engine operating conditions, in terms of engine speed N and fuel-injection pulse-width basic value Tp, indicate the region D of FIG. 3 and the program proceeds to the point 522 where a command is produced for fuel enrichment control. At the point 524 in the program, a determination is made as to whether or not 5 seconds have been elapsed. If the answer to this question is "YES", then the program proceeds to the point 516 where the fuelcut control (F/C) is started. Otherwise, the program is returned to the point 524. This is effective to continue the fuel enrichment control for 5 seconds before the fuelcut control is started.

If the answer to the question inputted at the point 504 is "NO", then the program proceeds to another determination step at the point 526. This determination is as to whether or not the engine operating conditions are in a recovery region specified for the fuel delivery to be resumed. For example, the fuel delivery to the engine is resumed when the throttle valve 46 opens or when the engine speed N is less than a predetermined value. If the answer to this question is "YES", then the program proceeds to the point 528 where a command is produced to terminate the fuelcut control (F/C) and to the point 530. Otherwise, the program proceeds directly to the point 530.

Although the catalytic converter temperature is estimate based on engine load (inferred from fuel injection pulse-width basic value Tp) and engine speed N, it is to be understood that the catalytic converter temperature may be detected with the use of an exhaust gas temperature sensor provided in the exhaust system upstream of the catalytic converter 24.

In this embodiment, therefore, the fuel delivery control apparatus is free from a temporarily catalyst degradation which may occur due to an excessive amount of air introduced into the catalytic converter operating at a high temperature.

Although the present invention has been described and illustrated in detail, it should be clearly understood that the same is by way of illustration and example only and is not to be taken by way of limitation, the spirit and scope of the present invention being limited only by the terms of the appended claims.

What is claimed is:

1. A fuel delivery control apparatus for use with an internal combustion engine including an exhaust system having a catalytic converter containing catalysts operable at a temperature for purifying exhaust gases discharged through the exhaust system, comprising:

means for performing fuelcut control to interrupt fuel delivery to the engine during engine deceleration;

means for estimating the catalyst temperature;

means for inhibiting the fuelcut control when the estimated catalyst temperature exceeds a predetermined value; and means for maintaining the fuelcut control inhibited as long as the engine deceleration continues.

2. The fuel delivery control apparatus as claimed in claim 1, further including:

means for detecting engine operating conditions;

means for performing fuel enrichment control to supply an increased amount of fuel to the engine when the detected engine operating conditions are in a region specified for fuel enrichment control;

means for measuring a period of time during which the fuel enrichment control is performed when the estimated catalyst temperature exceeds the predetermined value; and means for releasing the inhibition of the fuelcut control when the measured time period exceeds a predetermined value.

3. The fuel delivery control apparatus as claimed in claim 1, further including:

means for detecting engine operating conditions;

means for performing fuel enrichment control to supply an increased amount of fuel to the engine when the detected engine operating conditions are in a region specified for fuel enrichment control;

means for measuring a fuel amount increased during which the fuel enrichment control is performed when the estimated catalyst temperature exceeds the predetermined value;

means for measuring a fuel amount decreased during which the fuelcut control is performed when the estimated catalyst temperature exceeds the predetermined value; and means for releasing the inhibition of the fuelcut control when the measured increased fuel amount minus the measured decreased fuel amount exceeds a predetermined value.

* * * * *